United States Patent [19]

Nafziger et al.

[11] 4,133,967

[45] Jan. 9, 1979

[54] TWO-STAGE ELECTRIC ARC - ELECTROSLAG PROCESS AND APPARATUS FOR CONTINUOUS STEELMAKING

[75] Inventors: Ralph H. Nafziger, Albany; Gary L. Hundley, Corvallis; Ronald R. Jordan, Albany, all of Oreg.

[73] Assignee: The United States of America as represented by the Secretary of the Interior, Washington, D.C.

[21] Appl. No.: 809,879

[22] Filed: Jun. 24, 1977

[51] Int. Cl.[2] ..... F27B 19/04; F27D 15/00

[52] U.S. Cl. ..... 13/9 ES; 13/33; 164/83; 164/252

[58] Field of Search ..... 13/9 ES, 9, 33, 34; 164/82, 83, 52, 252, 266

[56] References Cited

U.S. PATENT DOCUMENTS

| | | | |
|---|---|---|---|
| 3,610,795 | 10/1971 | Antoine | 13/33 |
| 3,627,293 | 12/1971 | Sperner | 13/9 ES X |
| 3,768,998 | 10/1973 | Yonemochi | 13/9 ES X |

*Primary Examiner*—R. N. Envall, Jr.
*Attorney, Agent, or Firm*—William S. Brown; Donald A. Gardiner

[57] ABSTRACT

A conventional electric arc furnace is provided with an outlet in a sidewall of the furnace, the inner and outer ends of which are positioned such that the outer end of the outlet is higher than the inner end of the outlet. The outer end of the outlet communicates directly with a graphite electrode having a hollow interior leading from the sidewall of the electric arc furnace to an electroslag furnace positioned below the electric arc furnace. After an initial charge of ore in the electric arc furnace is brought to the molten state with the slag floating on top of the molten metal, the level of molten metal is maintained above the inner end of the slanted outlet and caused to flow through the slanted outlet and hollow graphite electrode to the electroslag furnace. In the electroslag furnace, the molten metal solidifies on a movable base plate positioned at the bottom of the furnace which is slowly withdrawn out of the bottom of the electroslag furnace, thereby continuously forming the desired steel ingot.

7 Claims, 4 Drawing Figures

TWO-STAGE ELECTRIC ARC - ELECTROSLAG PROCESS AND APPARATUS FOR CONTINUOUS STEELMAKING

BACKGROUND OF THE INVENTION

1. Field of the Invention

This invention relates to transfer processes in the treatment of molten iron and iron alloys by electro-thermic processes. The invention particularly relates to a technique for preparing ingots of various steel composition directly from prereduced iron ore pellets utilitzing a two-furnace process on a continuous basis. The invention incorporates a primary, single-phase AC electric arc furnace and a conventional cold-mold electroslag furnace. The process is particularly suitable for use at versatile small steel plants which are interested in inexpensive methods to serve customers with small tonnages of high quality steel ingots of particularly unique alloy composition.

2. Background of the Invention

Several years ago, increasing scrap shortages, decreasing quality and high scap costs made it necessary for the steelmakers to consider prereduced iron ore pellets as a supplemental charge material for electric arc furnaces. In a relatively short time, advantages of using prereduced iron ore pellets became apparent, and considerable success has been experienced in the development of efficient processes for their utilization in the preparation of a variety of steels. The use of prereduced iron ore pellets still requires, in conventional electric-arc furnace steelmaking, various degassing, casting, and conditioning steps to produce the desired quality material.

In an effort to simplify the operations, reduce costs, and minimize capital investments, the technique of electroslag melting was adopted which is particularly suitable for small tonnages. One disadvantage of using conventional electroslag techniques to melt prereduced iron ore pellets is that gangue oxides such as FeO, $SiO_2$, MgO, CaO, and $Al_2O_3$ are not easily handled without electrode and ore flux additions or with an additional prereduction step. This generally requires the formation of a consumable electrode of the proper composition and also generally requires a 92–93% metalization. Since the conventional electroslag process is a secondary melting technique, ingots with optimum properties are more easily and less expensively obtained if the gangue impurities have been removed prior to electroslag melting.

SUMMARY OF THE INVENTION

A process for preparing directly workable steel ingots from prereduced iron ore pellets in a continuous process was thus conceived, which included a method of transferring molten metal from an electric arc furnace into an electroslag furnace while retaining the undesired slag in the electric arc furnace. The electric arc furnace has, in a sidewall thereof, an outlet comprising an inner end and an outer end, the inner end being disposed below the outer end through which molten metal may be continuously withdrawn from the electric arc furnace. An electroslag furnace is positioned below the electric arc furnace for receiving the molten metal and for continuously forming a metal ingot of the molten metal. An electrode having a hollow core extends between the outlet of the electric arc furnace and the electroslag furnace for containing the molten metal as is moves therebetween. The level of the molten metal in the electric arc furnace is maintained above the inner end of the outlet. By continuous addition of metal ore, sufficient hydraulic pressure is supplied to cause the molten metal to flow through the outlet and through the interior of the hollow core electrode to the electroslag furnace where a metal ingot of the desired composition is continuously formed.

In a preferred embodiment, the outlet in the sidewall of the electric arc furnace is inclined at an angle of about 40° with respect to the vertical. Means, such as a continuous belt feeder, is supplied for continuously recharging the electric arc furnace with metal ore, preferably at a rate of about 4.8 weight percent of the total charge in the electric arc furnace per minute.

One advantage of this two-stage process is that it does not require the fabrication of consumable electrodes which is usually the most expensive step in conventional electroslag melting. Further, no relatively expensive deoxidizers are needed. Since the slag is all retained in the electric arc furnace, there is no increase in contamination of the electroslag flux as the melt progresses which is the usual problem encountered in conventional electroslag melting of prereduced iron ore pellets. Since the slag and gangue are largely retained in the electric are furnace, the electroslag top slag or flux can be continuously reused, and since it contains primarily $CaF_2$ which is presently in short supply, this is a significant advantage.

Inasmuch as the metal is molten when it reaches the electroslag furnace, a smaller power supply is required and lower overall power consumption is realized. The technique readily lends itself to a 24-hour continuous operation since the melt can be continued indefinitely with periodic ingot cutting.

No gate valve or other complicated mechanism is needed for the transfer of a molten metal without the slag from one furnace to another since the upwardly inclined outlet automatically performs a skimming function. This process simplifies operations, reduces operational costs, and requires minimal capital investment. The metal ingots produced by this process are observed to have improved axial solidification, workable smooth surfaces, and an overall reduction in the occurrence of inclusions. Other features and advantages of the invention will become apparent to those of ordinary skill in the art upon consideration of the following description of a preferred embodiment.

DESCRIPTION OF PREFERRED EMBODIMENTS

Figure 1:
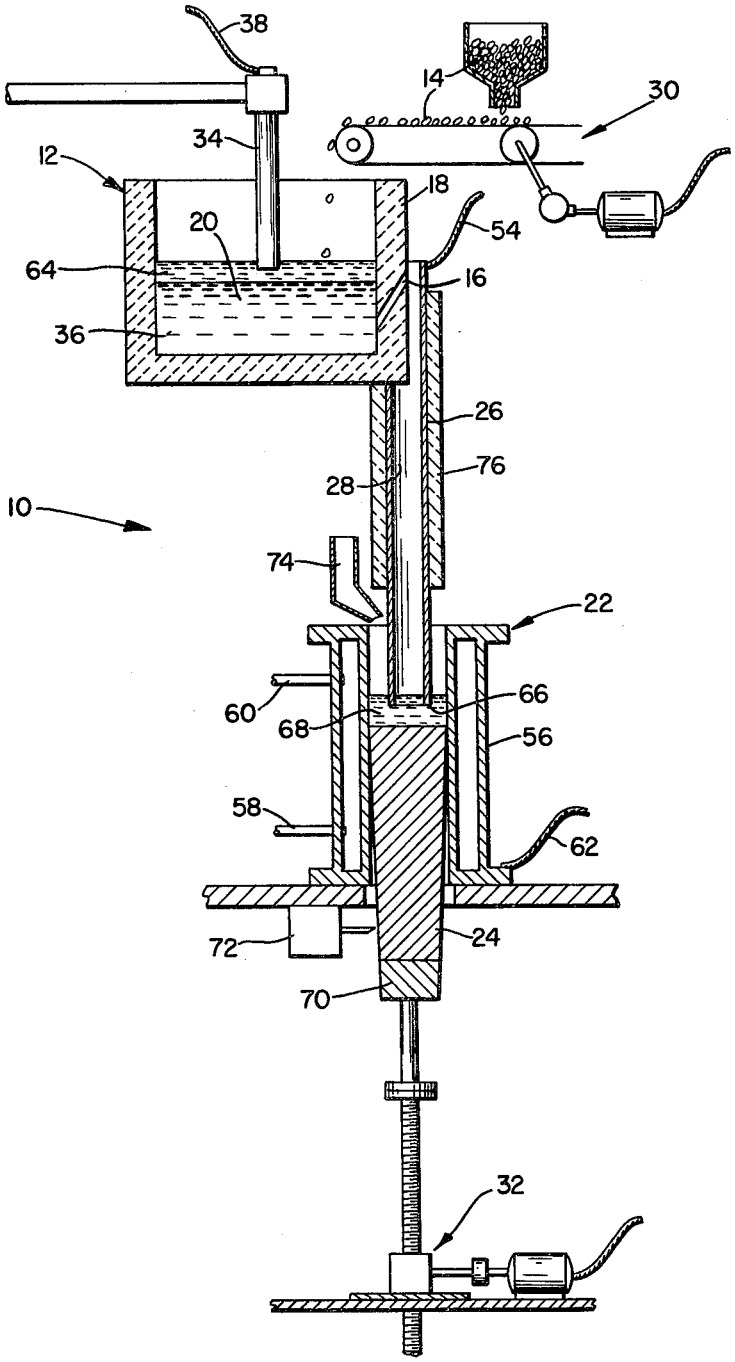
FIG. 1 is schematic representation of an apparatus for performing the process of this invention.

In FIG. 1, a two-stage electric arc — electroslag apparatus for carrying out the process of this invention is illustrated schematically. The apparatus comprises an electric arc furnace 12 for melting metal ore 14. The furnace has outlet 16 in a sidewall 18 through which the molten metal 20 can be withdrawn from the electric arc furnace 12. An electroslag furnace 22 is positioned below the electric arc furnace 12 for receiving the molten metal 20 therefrom and continuously forming a metal ingot 24. An electrode 26 having a hollow core 28 extends between the outlet 16 of the electric arc furnace 12 and the electroslag furnace 22 for containing the molten metal 20 as it moves between the two furnaces 12 and 22.

The apparatus 10 generally also comprises means 30 for continuously charging the electric arc furnace with metal ore and also generally further comprises means 32 for continuously withdrawing the formed metal ingot 24 from the bottom of the electroslag furnace 22. The charging means 30 can comprise any appropriate apparatus such as an endless belt conveyor or the like for supplying the electric arc furnace with metal ore 14, particularly the prereduced iron ore pellets used in the process of this invention. The withdrawing means 32 comprise a motor-driven screw jack as illustrated in FIG. 1 or any other appropriate means for slowly withdrawing the formed metal ingot 24 from the bottom of the electroslag furnace 22. Where the withdrawing means 32 is of a type which can continuously operate on a 24-hour basis, there can also be provided means 72 for periodically cutting the ingot 24 as it reaches the desired length.

The electric arc furnace 12 typically includes a plurality of electrodes 34 suspended immediately above the charge 36 for melting the charge 36 and maintaining the molten metal 20 in a liquid state. The electrodes 34 are supplied with A.C. power from an appropriate source via power lead 38. The electrodes 34 are typically vertically movable by an appropriate motor means so as to control power consumption and temperature of the electric arc furnace.

Figure 2:
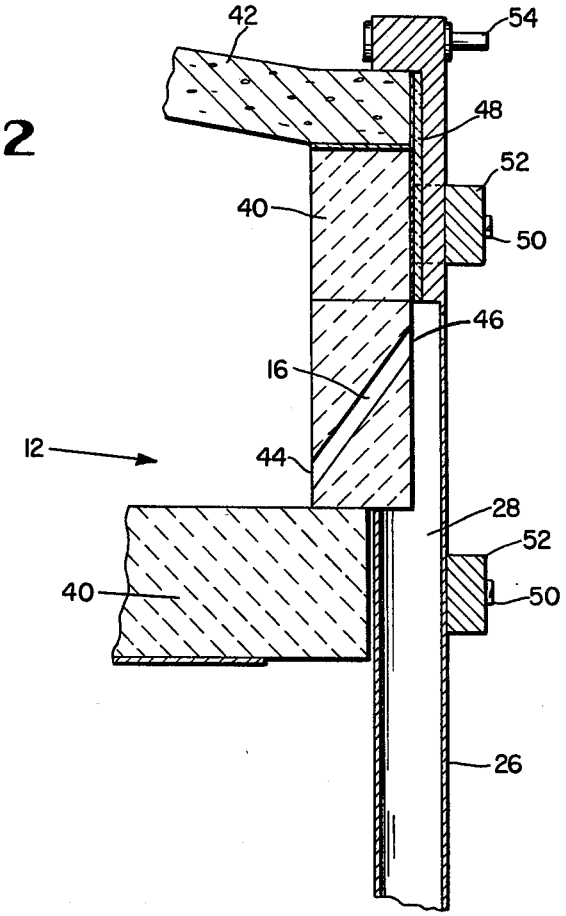
FIG. 2 is a sectional detail of a sidewall of the electric arc furnace employed in the process of this invention showing the slanted outlet in the sidewall to the hollow graphite electrode.

As illustrated in FIG. 2, the electric arc furnace 12 is typically lined with magnesite brick 40 while the furnace roof 42 is rammed with a high alumina mix. The outlet 16 leading through a sidewall 18 of the electric arc furnace 12 has an inner end 44 which is disposed below the outer end 46.

A hollow, non-consumable graphite electrode 26 is fixed to the sidewall 18 of the electric arc furnace 12. A layer of insulation 48 electrically and thermally insulates the electrode 26 from the furnace 12. Screw-fitted fasteners 50 and lava holding blocks 52 maintain the electrode 26 in fixed relationship to the furnace 12. The outlet 16 directly communicates with the hollow core 28 of the electrode 26. Electrical power is supplied to the electrode by way of the power lead 54.

As further illustrated in FIG. 1, the electroslag furnace 22 comprises a water-cooled copper crucible 56 through which cooling water is continuously circulated by way of inlet 58 and outlet 60. Power is supplied to operate the electroslag furnace 22 through power lead 54 attached to the non-consumable electrode 26 and power lead 62 attached to the crucible 56.

In operation, the invention removes the gangue materials from the prereduced iron ore pellets 14 by melting them in the electric arc furnace 12. This procedure separates the molten metal 20 from the oxides which report to the layer of slag 64 which floats on top of the molten metal 20. The molten metal 20 is than allowed to flow out of the electric arc furnace 12 through the outlet 16 into the hollow interior 28 of the non-consumable graphite electrode 26 and into the electroslag furnace 22. The outlet 16 is designed so that the slag 64 is prevented from flowing into the electroslag furnace 22. The electrode 26 can be wrapped with a layer of insulation 76 to help prevent premature solidification of the molten metal 20 inside the hollow interior 28.

The lower end 66 of the hollow graphite electrode 26 is immersed in a molten flux 68 inside the electroslag furnace 22. The molten metal 20 from the electric arc furnace flowing downward through the hollow interior 28 of electrode 26 passes through this molten flux layer 68 and solidifies on a movable baseplate 70 positioned at the bottom of the electroslag furnace 22.

As the solidified metal 24 builds up, the baseplate 70 is continuously withdrawn to maintain optimum voltage and amperage levels between the bottom 66 of the graphite electrode 26 and the top of the solidifying ingot 24. The continuous flow of molten metal 20 down through the hollow interior 28 of electrode 26 is insured by the continuous addition of metal ore 14 at such a rate as will permit both the electric arc and electroslag furnaces to perform their intended function. The flow of molten metal 20 through outlet 16 is hydraulically induced by the continuous addition of the pelletized ore 14. As the process continues, the ingot 24 which has the typical properties of electroslag melting is slowly withdrawn out of the bottom of the electroslag furnace 22 by an appropriate drawing means 32. Suitable amounts of ferroalloy powders can be directly added to the electroslag furnace by any appropriate adding means 74.

EXAMPLE

Approximately 9 kg. of a mixture containing 88 wt. % prereduced iron ore pellets, 10 wt. % lime, and 2 wt. % fluorspar is initially fed into an oval-shaped electric arc furnace as previously described (66 cm. long, 46 cm. wide, 33 cm. deep). Single-phase power is supplied to the electrodes of the electric arc furnace from 3 A.C. transformers (60 V. at 2,100 amp). As soon as a molten pool has been established, approximately 59 kg. of the same mixture is continuously charged from a small continuous belt feeder into the electric arc furnace at a rate of 1.7 kg. per minute. The bath is then decarburized by adding approximately 4.5 kg. of iron ore pellets containing at least 70 wt. % $Fe_2O_3$. A small quantity of ferroalloys subsequently can be added to insure eventual ingot homogeneity. Power is then applied to a 104 cm. long by 5.7 cm. inside diameter hollow graphite electrode from one single-phase A.C. transformer after approximately 500 grams of dry oxyfluoride flux has been added to a 10.2 cm.-diameter slag furnace. The hollow graphite electrode is attached to the electric arc furnace at the location of an outlet. A metal starting stub supported in the bottom of the electroslag furnace by a motor-driven screw jack is adjusted to initiate fusion of the flux. After fusion of the flux, the power to the electroslag furnace is then increased and the previously botted, slanted outlet in the sidewall of the electric arc furnace is opened. This outlet is constructed so that its lower end is located adjacent to the base of the inside of the electric arc furnace and extends upward at an approximate 40° angle from the vertical to the outside of the furnace. The outlet serves as a slag skimmer and allows only the molten metal to flow outside the electric arc furnace into the hollow graphite non-consumable electroslag electrode and through the layer of molten flux. More of the same mixture is again continuously charged into the electric arc furnace at a rate of approximately 2.8 kg. per minute (about 4.8 wt. % of the total charge in the electric arc furnace per minute) to maintain a sufficiently high bath level to provide a small steady stream of molten metal. The molten metal then solidifies in the electroslag furnace to form the ingot which is continuously withdrawn from the bottom of the electroslag furnace by a motordriven screw jack at a rate of approximately 4 cm. per minute. Simultaneously suitable amounts of ferroalloy powders can be added directly to the electroslag furnace throughout the withdrawal period to produce an ingot of the desired steel composition and to maximize elemental recovery. When the ingot has been withdrawn to a desired length (51 cm. in this case), the feed to the electric arc furnace is stopped, the molten metal overflow then terminates, and the electric arc furnace opening is then tapped. The ingot is then removed for further treatment. The process can be continuously performed if desired.

Ingots having the desired properties such as a directly workable smooth surface, a sound interior, columnar grains and minimal inclusions have been prepared by this method. Compositions included AISI 1059, 1060, 1065, and 1095 plain carbon steels and an SAE 5060 high alloy steel. Table I shows typical ingot compositions and hardnesses which have been prepared successfully using this invention. The ingots are nominally 10.2 cm. in diameter and average from 46 to 51 cm. in length.

Table 1

Compositions (wt %)[1] and hardnesses of typical ingots prepared by the two-stage electric arc/electroslag process and comparisons with commercial steel compositions.

| | C | S | P | Mn | Si | Cr | BHN[2] surface | BHN[2] interior |
|---|---|---|---|---|---|---|---|---|
| Ingot 20 | 0.62±0.05 | 0.005 | 0.011 | 0.63±0.38 | 0.15±0.10 | — | 276 | 244 |
| AISI 1059 | 0.55–0.65 | [3]0.05 | [3]0.04 | 0.50–0.80 | — | — | | |
| 1060 | " | " | " | 0.60–0.90 | — | — | | |
| 1065 | 0.60–0.70 | " | " | " | — | — | | |
| Ingot 21 | 1.09±0.15 | 0.015 | 0.016 | 0.42±0.05 | 0.01 | — | 270 | 267 |
| AISI 1095 | 0.90–1.03 | [3]0.05 | [3]0.04 | 0.30–0.50 | — | — | | |
| Ingot 23 | 0.56±0.05 | 0.005 | 0.006 | 0.49±0.06 | 0.02 | — | 221 | 223 |
| AISI 1059 | 0.55–0.65 | [3]0.05 | [3]0.04 | 0.50–0.80 | — | — | | |
| Ingot 24 | 0.60±0.07 | 0.006 | 0.009 | 0.75±0.09 | 0.28±0.07 | 0.56±0.12 | 331 | 288 |
| SAE 5060 | 0.56–0.64 | [3]0.04 | [3]0.035 | 0.75–1.00 | .020–0.35 | 0.40–0.60 | | |

[1]One standard deviation given.
[2]3,000 kg load, 10 mm steel ball used.
[3]Maximum.

Figure 3:
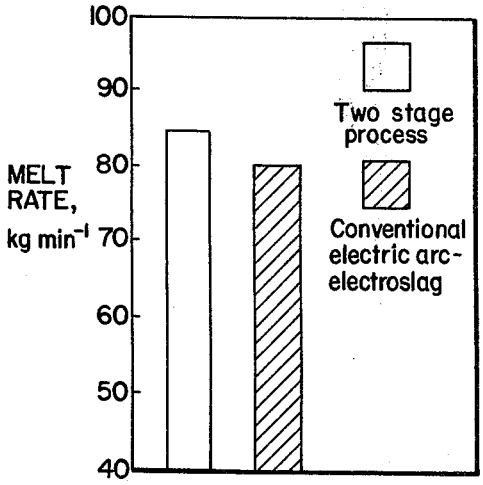
FIG. 3 is a graph illustrating the superior melt rate experienced when performing the process of this invention.

Scale-up of this process to larger scale operations should pose no problem. With larger furnaces, the temperature fluctuations would be less important in magnitude and frequency. In addition, variations in feed rate will have a smaller effect on the bath level, and therefore on the molten metal overflow stream. In larger furnaces, the tendency for molten metal to freeze as it is being transferred from the electric arc furnace to the electroslag furnace would be less pronounced because the flow rate would be greater. This tendency for the molten metal to freeze on the interior of the hollow electroslag furnace electrode can be largely eliminated even on smaller operations by wrapping the electrode with an appropriate layer of insulation. The process is particularly suitable for applications involving production of shafts and rolling mill rollers where variations in compositions from the top to the bottom of the ingot might be desired. The process is especially suitable for applications involving large process melts of alloys having an ingot structural tolerance for relatively high solidification rates. The high melt rate achievable via this process is demonstrably better than conventional electric arc — electroslag processing as is illustrated in FIG. 3.

Figure 4:
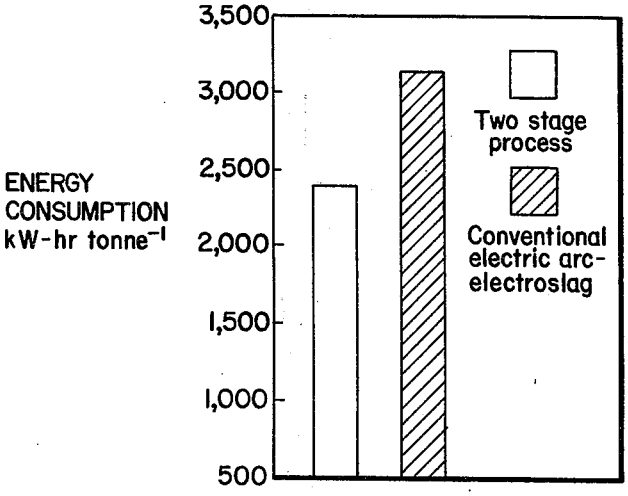
FIG. 4 is a graph illustrating the superior energy consumption experienced when performing the process of this invention.

Inasmuch as the metal is molten when it reaches the electroslag furnace, a smaller power supply is required, and lower overall power consumption is realized. The energy consumption for the two-stage process according to this invention has been demonstrated to be about 25% lower than that when the charged materials are melted in an electric arc furnace and the resulting ingot remelted in a conventional electroslag furnace to achieve comparable ingot quality. This comparison is shown dramatically in FIG. 4. Although the invention has been described in considerable detail with reference to preferred embodiments and examples thereof, it will be understood that variations and modifications can be effected within the spirit and scope of the invention as described above and as defined in the appended claims.

What is claimed is:

1. A two-stage electric arc — electroslag apparatus comprising:

(a) an electric arc furnace for melting metal ore, the furnace having an outlet in a sidewall thereof for continuously withdrawing molten metal therefrom, the outlet comprising an inner end and an outer end, the inner end being disposed below the outer end, (b) an electroslag furnace positioned below the electric arc furnace for receiving the molten metal therefrom and continuously forming a metal ingot, and (c) an electrode having a hollow core extending between the outlet of the electric arc furnace and the electroslag furnace for containing the molten metal as it moves therebetween.

2. The apparatus of claim 1 wherein said outlet is inclined at an angle of about 40 degrees with respect to the vertical.

3. The apparatus of claim 1 further comprising means for continuously charging the electric arc furnace with metal ore.

4. The apparatus of claim 1 wherein the electroslag furnace further comprises means for continuously withdrawing the formed metal ingot from the bottom of the electroslag furnace.

5. A method of transferring a molten metal from an electric arc furnace into an electroslag furnace while retaining undesired slag in the electric arc furnace comprising the steps of:

(a) providing an outlet in a sidewall of the electric arc furnace, the outlet having an inner end and an outer end, the outer end being higher than the inner end, (b) providing a graphite electrode having a hollow interior leading from the outer end of the outlet of the electric arc furnace to the electroslag furnace, the outer end of the outlet communicating directly with the hollow interior of the graphite electrode, and (c) maintaining the level of molten metal in the electric arc furnace above the inner end of the outlet while maintaining the level of molten metal and slag above the outer end of the outlet, thereby providing sufficient hydraulic pressure to cause the molten metal to flow through the outlet.

6. The method of claim 5 wherein the transfer is initiated by:

(a) applying power to the graphite electrode up to the operating level of the electroslag furnace, and (b) adding ore to the electric arc furnace so as to raise the level of the molten metal and slag within the electric arc furnace.

7. The method of claim 5 wherein metal ore is continuously added to the electric arc furnace at a rate of about 4.8 weight percent per minute.

* * * * *